US008218776B2

(12) United States Patent
Wu

(10) Patent No.: US 8,218,776 B2
(45) Date of Patent: Jul. 10, 2012

(54) SURGE PROTECTION CIRCUIT FOR AUDIO OUTPUT DEVICE

(75) Inventor: Chun-Te Wu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 202 days.

(21) Appl. No.: 12/696,155

(22) Filed: Jan. 29, 2010

(65) Prior Publication Data

US 2011/0123033 A1 May 26, 2011

(30) Foreign Application Priority Data

Nov. 26, 2009 (CN) ..... 2009 1 0310517

(51) Int. Cl.

| | |
|---|---|
| ***H04R 5/00*** | (2006.01) |
| ***H04B 15/00*** | (2006.01) |
| ***H03F 99/00*** | (2009.01) |
| ***H03F 1/14*** | (2006.01) |
| ***H03F 1/52*** | (2006.01) |
| ***H02H 3/30*** | (2006.01) |
| ***H02H 1/04*** | (2006.01) |

(52) U.S. Cl. ..... 381/28; 381/120; 381/94.1; 381/94.5; 361/91.1; 361/117; 361/118; 330/51; 330/207 P

(58) Field of Classification Search ..... 381/28, 381/94.8, 94.1, 94.5, 120, 56–59; 361/91.1, 361/117, 118; 330/51, 207 P, 298
See application file for complete search history.

(56) References Cited

U.S. PATENT DOCUMENTS

| | | | | |
|---|---|---|---|---|
| 4,198,541 | A * | 4/1980 | Fukushima | 381/94.8 |
| 4,216,430 | A * | 8/1980 | Amazawa et al. | 455/219 |
| 4,324,950 | A * | 4/1982 | Strickland | 381/120 |
| 5,199,079 | A * | 3/1993 | Anderson et al. | 381/94.5 |
| 5,224,010 | A * | 6/1993 | Tran et al. | 361/90 |
| 5,677,960 | A * | 10/1997 | Unno et al. | 381/86 |
| 5,734,729 | A * | 3/1998 | Tran | 381/94.5 |
| 5,740,453 | A * | 4/1998 | Lada, Jr. | 713/330 |
| 5,768,601 | A * | 6/1998 | Tran | 713/300 |
| 5,774,557 | A * | 6/1998 | Slater | 381/56 |
| 5,794,057 | A * | 8/1998 | Lada, Jr. | 713/300 |
| 6,041,416 | A * | 3/2000 | Lada, Jr. | 713/330 |
| 6,473,510 | B1 * | 10/2002 | Marsh | 381/94.6 |
| 6,573,786 | B2 * | 6/2003 | Lee et al. | 330/51 |
| 7,058,189 | B1 * | 6/2006 | Grimm et al. | 381/119 |
| 7,164,312 | B1 * | 1/2007 | Singh et al. | 330/9 |
| 7,170,732 | B2 * | 1/2007 | Andersen et al. | 361/97 |
| 7,463,742 | B2 * | 12/2008 | Inagaki | 381/94.5 |
| 7,492,217 | B2 * | 2/2009 | Hansen et al. | 330/10 |
| 2007/0121961 | A1 * | 5/2007 | Tsai | 381/94.5 |
| 2008/0056513 | A1 * | 3/2008 | Rashid | 381/94.5 |
| 2008/0069376 | A1 * | 3/2008 | Rashid et al. | 381/94.5 |
| 2008/0089532 | A1 * | 4/2008 | Lee et al. | 381/94.5 |
| 2008/0170720 | A1 * | 7/2008 | Rashid | 381/94.5 |
| 2008/0260185 | A1 * | 10/2008 | Tseng et al. | 381/123 |

FOREIGN PATENT DOCUMENTS

CN 1941620 A 4/2007

* cited by examiner

*Primary Examiner* — Devona Faulk
(74) *Attorney, Agent, or Firm* — Altis Law Group, Inc.

(57) ABSTRACT

A surge protection circuit acquires a surge signal from a left channel (LC) signal line and a right channel (RC) signal line. After the surge signal being transmitted on the LC signal line and the RC signal line is removed, an audio signal outputted from a signal input device is transmitted to an audio output device via the LC signal line and the RC signal line.

6 Claims, 1 Drawing Sheet

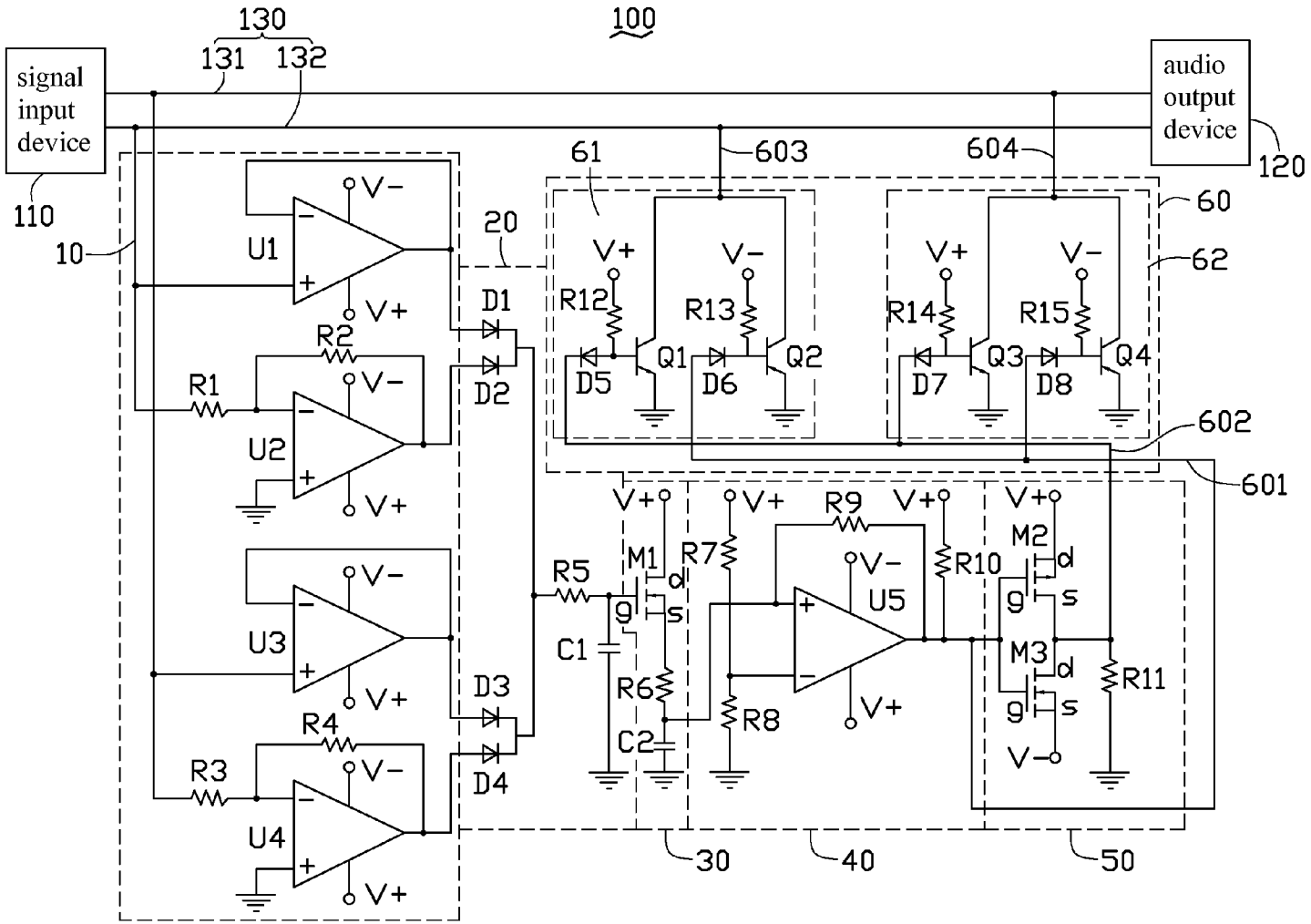
audio output device
120
signal input device
110
100
130
131
132
10
20
30
40
50
60
61
62
601
602
603
604
U1
U2
U3
U4
U5
R1
R2
R3
R4
R5
R6
R7
R8
R9
R10
R11
R12
R13
R14
R15
C1
C2
M1
M2
M3
D1
D2
D3
D4
D5
D6
D7
D8
Q1
Q2
Q3
Q4
V+
V−
g
d
s

SURGE PROTECTION CIRCUIT FOR AUDIO OUTPUT DEVICE

BACKGROUND

Technical Field

This present disclosure relates to surge protection circuits, and particularly, to a surge protection circuit to remove surge signals from inputting to an audio output device.

Generally, if an audio device is turned off and immediately turned on, the residual charges remaining in the audio devices may induce a surge signal in sound signal lines. As a result, there will be a pop sound before a normal sound output from the audio devices.

Therefore, a surge protection circuit which can overcome the above-described problems is desirable.

BRIEF DESCRIPTION OF THE DRAWING

Many aspects of the embodiments can be better understood with reference to the following drawing. The components in the drawing are not necessarily drawn to scale, the emphasis instead being placed upon clearly illustrating the principles of the present embodiments.

The FIGURE is a circuit diagram of a surge protection circuit in accordance with an exemplary embodiment.

DETAILED DESCRIPTION

Embodiments of the disclosure are now described in detail with reference to the drawing.

Referring to the FIGURE, a surge protection circuit 100, according to an exemplary embodiment, is structured and arranged to remove a surge signal induced in sound signal lines 130, which are interposed between a signal input device 110 and an audio output device 120. The signal input device 110 can be a system-on-chip (SoC) that can generate and output an audio signal including a right channel (RC) signal and a left channel (LC) signal. The audio output device 120 can be a speaker or an earphone. The sound signal lines 130 include a RC signal line 131 and a LC signal line 132.

The surge protection circuit 100 includes a signal acquiring circuit 10, a electric charge accumulation circuit 20, a time delay circuit 30, a Schmitt trigger circuit 40, a negation circuit 50, and a mute circuit 60.

The signal acquiring circuit 10 includes a first amplifier U1, a second amplifier U2, a third amplifier U3, a fourth amplifier U4, a first resistor R1, a second resistor R2, a third resistor R3, and a fourth resistor R4. The first amplifier U1 includes a positive input terminal coupled to the LC signal line 132, a negative input terminal, and an output terminal coupled to the negative input terminal. The second amplifier U2 includes a positive input terminal that is grounded, a negative input terminal coupled to the LC signal line 132 via the first resistor R1, and an output terminal coupled to the negative input terminal via the second resistor R2. The third amplifier U3 includes a positive input terminal coupled to the RC signal line 131, a negative input terminal, and an output terminal coupled to the negative input terminal. The fourth amplifier U4 includes a positive input terminal that is grounded, a negative input terminal coupled to the RC signal line 131 via the third resistor R3, and an output terminal coupled to the negative input terminal via the fourth resistor R4. In one embodiment, the first, second, third, and fourth amplifiers U1, U2, U3, and U4 may be type LM324 amplifiers. In one embodiment resistances of the first resistor R1 and the third resistor R3 are about 40KΩ, where resistances of the second resistor R2 and the fourth resistor R4 are about 40KΩ.

The electric charge accumulation circuit 20 includes a first diode D1, a second diode D2, a third diode D3, a fourth diode D4, a fifth resistor R5, and a first capacitor C1. The first diode D1 includes an anode coupled to the output of the first amplifier U1 and a cathode. The second diode D2 includes an anode coupled to the output of the second amplifier U2 and a cathode coupled to the cathode of the first diode D1. The third diode D3 includes an anode coupled to the output terminal of the third amplifier U3 and a cathode. The fourth diode D4 includes an anode coupled to the output terminal of the fourth amplifier U4 and a cathode coupled to the cathode of the third diode D3. The fifth resistor R5 includes a first terminal coupled to the cathodes of the first, second, third, and fourth diodes D1, D2, D3, and D4 and a second terminal. The first capacitor C1 includes a first terminal coupled to the second terminal of the fifth resistor R5 and a second terminal that is grounded. In one embodiment resistance of the fifth resistor R5 is about 100Ω, where charging capacity of the first capacitor C1 is about 6.8 uF.

The time delay circuit 30 includes a first MOSFET M1, a sixth resistor R6, and a second capacitor C2. The first MOSFET M1 is an n-channel metal oxide semiconductor (NMOS) transistor, and includes a drain "d" connected to a positive voltage V+, for example, +3.3 v, a source "s", and a gate "g" coupled to the second terminal of the fifth resistor R5. The second capacitor C2 includes a first terminal coupled to the source "s" via the sixth resistor R6 and a second terminal that is grounded. In one embodiment resistance of the sixth resistor R6 is about 4.7 kΩ, where charging capacity of the second capacitor C2 is about 68 uF.

The Schmitt trigger circuit 40 includes a fifth amplifier U5, a seventh resistor R7, an eighth resistor R8, a ninth resistor R9, and a tenth resistor R10. The fifth amplifier U5 includes a positive input terminal coupled to the first terminal of the second capacitor C2, a negative input terminal, and an output terminal coupled to the positive input terminal via the ninth resistor R9. The seventh resistor R7 includes a first terminal coupled to the negative input terminal of the fifth amplifier U5 and a second terminal connected to the positive voltage V+. The eighth resistor R8 includes a first terminal coupled to the negative input terminal of the fifth amplifier U5 and a second terminal that is grounded. The tenth resistor R10 includes a first terminal coupled to the output terminal of the fifth amplifier U5 and a second terminal connected to the positive voltage V+. In one embodiment resistances of the seventh, eighth, ninth, and tenth resistors R7, R8, R9, and R10 are about 10 kΩ, 510Ω, 20 kΩ, and 2.2 kΩ, respectively.

The negation circuit 50 includes a second MOSFET M2, a third MOSFET M3, and an eleventh resistor R11. The second MOSFET M2 is a p-channel metal oxide semiconductor (PMOS) transistor, and includes a drain "d" connected to the positive voltage V+, a source "s", and a gate "g" coupled to the output terminal of the fifth amplifier U5. The third MOSFET M3 is an n-channel metal oxide semiconductor (NMOS) transistor, and includes a source "s" connected to a negative voltage V−, for example, −3.3 v, a drain "d" coupled to the source "s" of the second MOSFET M2, and a gate "g" coupled to the output terminal of the fifth amplifier U5. The eleventh resistor R11 includes a first terminal coupled to the source "s" of the second MOSFET M2 and the drain "d" of the third MOSFET M3 and a second terminal that is grounded. In one embodiment resistance of the eleventh resistor R11 is about 10 kΩ.

The mute circuit 60 includes a LC mute circuit 61 and a RC mute circuit 62. The mute circuit 60 includes a first input terminal 601, a second input terminal 602, a first output terminal 603, and a second output terminal 604. The first input terminal 601 and the second input terminal 602 are coupled to the output terminal of the fifth amplifier U5 and the first terminal of the eleventh resistor R11 respectively. The first output terminal 603 and the second output terminal 604 are coupled to the LC signal line 132 and the RC signal line 131 respectively.

The LC mute circuit 61 includes a fifth diode D5, a sixth diode D6, a first bipolar junction transistor Q1, a second bipolar junction transistor Q2, a twelfth resistor R12, and a thirteenth resistor R13. The fifth diode D5 includes an anode connected to the positive voltage V+ via the twelfth resistor R12 and a cathode coupled to the first input terminal 601 of the mute circuit 60. The first bipolar junction transistor Q1 is an npn type, and includes a collector "c" coupled to the first output terminal 603 of the mute circuit 60, a emitter "e" that is grounded, and a base "b" coupled to the anode of the fifth diode D5. The sixth diode D6 includes an anode coupled to the second input terminal 602 of the mute circuit 60 and a cathode connected to the negative voltage V− via the thirteenth resistor R13. The second bipolar junction transistor Q2 is a pnp type, and includes a collector "c" coupled to the first output terminal 603 of the mute circuit 60, a emitter "e" that is grounded, and a base "b" coupled to the cathode of the sixth diode D6. In one embodiment resistances of the twelfth resistor R12 and the thirteenth resistor R13 are about 10 kΩ.

The RC mute circuit 62 includes a seventh diode D7, an eighth diode D8, a third bipolar junction transistor Q3, a fourth bipolar junction transistor Q4, a fourteenth resistor R14, and a fifteenth resistor R15. The seventh diode D7 includes an anode connected to the positive voltage V+ via the twelfth resistor R14 and a cathode coupled to the first input terminal 601 of the mute circuit 60. The third bipolar junction transistor Q3 is an npn type, and includes a collector "c" coupled to the second output terminal 604 of the mute circuit 60, a emitter "e" that is grounded, and a base "b" coupled to the anode of the seventh diode D7. The eighth diode D8 includes an anode coupled to the second input terminal 602 of the mute circuit 60 and a cathode connected to the negative voltage V− via the fifteenth resistor R15. The fourth bipolar junction transistor Q4 is a pnp type, and includes a collector "c" coupled to the second output terminal 604 of the mute circuit 60, a emitter "e" that is grounded, and a base "b" coupled to the cathode of the eighth diode D8. In this embodiment, the resistances of the fourteenth resistor R14 and the fifteenth resistor R15 are 10 kΩ.

In a normal operating condition, the first MOSFET M1 is disconnected. The output terminal of the fifth amplifier U5 outputs a negative voltage V− to the gate "g" of the second MOSFET M2 and the third MOSFET M3. Therefore, the second MOSFET M2 is connected and the third MOSFET M3 is disconnected, as a result, the first terminal of the eleventh resistor R11 is pulled to the positive voltage V+. The first input terminal 601 and the second input terminal 602 of the mute circuit 60 are the positive voltage V+ and the negative voltage V− respectively. The cathodes of the fifth diode D5 and the seventh diode D7 are the positive voltage V+, and the anodes of the sixth diode D6 and the eighth diode D8 are the negative voltage V−. Therefore, the fifth, sixth, seventh, and eighth diodes D5, D6, D7, and D8 are disconnected, and the first, second, third, and fourth bipolar junction transistors Q1, Q2, Q3, and Q4 are connected. The LC signal line 132 and the RC signal line 131 are grounded and in a non-conducting state, as a result, the sound signals of the LC signal line 132 and the RC signal line 131 can not be transmitted from the signal input device 110 to the audio output device 120.

If an ON operation is performed immediately after an OFF operation, and the RC signal line 131 and LC signal line 132 induce a surge signal, such as, a positive voltage pulse or a negative voltage pulse, before the signal input device outputs an audio signal. The first amplifier U1 and the second amplifier U2 acquire the surge signal of the LC signal line, the third amplifier U3 and fourth amplifier U4 acquire the surge signal of the RC signal line. In this embodiment, the first amplifier U1 and the third amplifier U3 amplify the surge signal with a positive voltage, the second amplifier U2 and the fourth amplifier U4 amplify the surge signal with a negative voltage. The first, second, third, and fourth amplifiers U1, U2, U3, and U4 output the amplified surge signal to the first, second, third, and fourth diodes D1, D2, D3, and D4. The first capacitor C1 is charged by the amplified surge signal. When the charging voltage of the first capacitor C1 exceeds the threshold voltage of the first MOSFET M1, the drain "d" and the source "s" of the first MOSFET M1 are connected. Consequently, the second capacitor C2 is charged by the positive voltage V+. Before the charging voltage of the second capacitor C2 exceeds the positive threshold voltage of the Schmitt trigger circuit 40, the Schmitt trigger circuit 40 continues outputting the negative voltage V−. The LC signal line 132 and the RC signal line 131 remain in the non-conducting state, therefore, the surge signal of the left channel LC and the right channel RC is removed.

When the charging voltage of the second capacitor C2 exceeds the positive threshold voltage of the Schmitt trigger circuit 40, the Schmitt trigger circuit 40 outputs the positive voltage V+ to the gate "g" of the second MOSFET M2 and the third MOSFET M3. Therefore, the second MOSFET M2 is disconnected and the third MOSFET M3 is connected, and the first terminal of the eleventh resistor R11 is connected to the negative voltage V−. The first input terminal 61 and the second input terminal 62 of the mute circuit 60 are the negative voltage V− and the positive voltage V+respectively. The cathodes of the fifth diode D5 and the seventh diode D7 are the positive voltage V+, and the anodes of the sixth diode D6 and the eighth diode D8 are the positive voltage V+. Therefore, the fifth, sixth, seventh, and eighth diodes D5, D6, D7, and D8 are connected, and the first, second, third, and fourth bipolar junction transistor Q1, Q2, Q3, and Q4 are disconnected. The RC signal line 131 and the LC signal line 132 are in a conducting state, as a result, the audio signal after the surge signal can be transmitted from the signal input device 110 to the audio output device 120.

It will be understood that the above particular embodiments and methods are shown and described by way of illustration only. The principles and the features of the present disclosure may be employed in various and numerous embodiment thereof without departing from the scope of the disclosure as claimed. The above-described embodiments illustrate the scope of the disclosure but do not restrict the scope of the disclosure.

What is claimed is:

1. A surge protection circuit, comprising:

a signal acquiring circuit to acquire and amplify signals of a left channel (LC) signal line and a right channel (RC) signal line;

an electric charge accumulation circuit comprising a first capacitor configured to accumulate electric charge of the amplified signals;

a time delay circuit comprising a second capacitor structured and arranged such that, the time delay circuit is triggered by the electric charge of the first capacitor and the second capacitor is charged by a positive voltage;

a Schmitt trigger circuit to output a negative voltage or a positive voltage according to the electric charge of the second capacitor;

a negation circuit to reverse the negative voltage and the positive voltage output from the Schmitt trigger circuit; and a mute circuit comprising a first input terminal coupled to the Schmitt trigger circuit, a second input terminal coupled to the negation circuit, a first output terminal coupled to the LC signal line, and a second output terminal coupled to the RC signal line;

wherein, when the Schmitt trigger circuit outputs a negative voltage and the negation circuit outputs a positive voltage, the LC signal line and RC signal line are in a non-conducting state; when the Schmitt trigger circuit outputs a positive voltage and the negation circuit outputs a negative voltage, the LC signal line and RC signal line are in a conducting state;

wherein the signal acquiring circuit comprises: a first amplifier comprising a positive input terminal coupled to the LC signal line, a negative input terminal, and an output terminal coupled to the negative input terminal; a second amplifier comprising a positive input terminal that is grounded, a negative input terminal coupled to the LC signal line via a first resistor, and an output terminal coupled to the negative input terminal via a second resistor; a third amplifier comprising a positive input terminal coupled to the RC signal line, a negative input terminal, and an output terminal coupled to the negative input terminal; and a fourth amplifier comprising a positive input terminal that is grounded, a negative input terminal coupled to the RC signal line via a third resistor, and an output terminal coupled to the negative input terminal via a fourth resistor;

wherein the electric charge accumulation circuit further comprises: a first diode comprising an anode coupled to the output of the first amplifier and a cathode; a second diode comprising an anode coupled to the output of the second amplifier and a cathode coupled to the cathode of the first diode; a third diode comprising an anode coupled to the output terminal of the third amplifier and a cathode; a fourth diode comprising an anode coupled to the output terminal of the fourth amplifier and a cathode coupled to the cathode of the third diode; a fifth resistor comprising a first terminal coupled to the cathodes of the first, second, third, and fourth diodes and a second terminal; the first capacitor comprising a first terminal coupled to the second terminal of the fifth resistor and a second terminal that is grounded;

wherein the time delay circuit further comprises: a first MOSFET being an n-channel metal oxide semiconductor (NMOS) transistor that comprises a drain connected to a positive voltage, a source, and a gate coupled to the second terminal of the fifth resistor; a second capacitor comprising a first terminal coupled to the source via a sixth resistor and a second terminal that is grounded;

wherein the Schmitt trigger circuit comprises: a fifth amplifier comprising a positive input terminal coupled to the first terminal of the second capacitor, a negative input terminal, and an output terminal coupled to the positive input terminal via a ninth resistor; a seventh resistor comprising a first terminal coupled to the negative input terminal of the fifth amplifier and a second terminal connected to a positive voltage; a eighth resistor comprising a first terminal coupled to the negative input terminal of the fifth amplifier and a second terminal that is grounded; a tenth resistor comprising a first terminal coupled to the output terminal of the fifth amplifier and a second terminal connected to a positive voltage.

2. The surge protection circuit in claim 1, wherein the RC signal line and LC signal line are electrically connected between a signal input device and an audio output device.

3. The surge protection circuit in claim 1, wherein the negation circuit comprises: a second MOSFET being a p-channel metal oxide semiconductor (PMOS) transistor that comprises a drain connected to a positive voltage, a source, and a gate coupled to the output terminal of the fifth amplifier; a third MOSFET being an n-channel metal oxide semiconductor (NMOS) transistor, and comprising a source connected to a negative voltage, a drain coupled to the source of the second MOSFET, and a gate coupled to the output terminal of the fifth amplifier; a eleventh resistor comprising a first terminal coupled to the source of the second MOSFET and the drain of the third MOSFET and a second terminal that is grounded.

4. The surge protection circuit in claim 3, wherein the mute circuit comprises a LC mute circuit and a RC mute circuit; the mute circuit comprises a first input terminal coupled to the output terminal of the fifth amplifier, a second input terminal coupled to the first terminal of the eleventh resistor, a first output terminal coupled to the LC signal line, and a second output terminal coupled to the RC signal line.

5. The surge protection circuit in claim 4, wherein the LC mute circuit comprises: a fifth diode comprising an anode connected to a positive voltage via a twelfth resistor and a cathode coupled to the second input terminal of the mute circuit; a first bipolar junction transistor being an npn type, and comprising a collector coupled to the first output terminal of the mute circuit, a emitter that is grounded, and a base coupled to the anode of the fifth diode; a sixth diode comprising an anode coupled to the first input terminal of the mute circuit and a cathode connected to a negative voltage via a thirteenth resistor; a second bipolar junction transistor being a pnp type, and comprising a collector coupled to the first output terminal of the mute circuit, a emitter that is grounded, and a base coupled to the cathode of the sixth diode.

6. The surge protection circuit in claim 4, wherein the RC mute circuit comprises: a seventh diode comprising an anode connected to a positive voltage via a fourteenth resistor and a cathode coupled to the second input terminal of the mute circuit; a third bipolar junction transistor being an npn type, and comprising a collector coupled to the second output terminal of the mute circuit, a emitter that is grounded, and a base coupled to the anode of the seventh diode; an eighth diode comprising an anode coupled to the first input terminal of the mute circuit and a cathode connected to a negative voltage via a fifteenth resistor; a fourth bipolar junction transistor being a pnp type, and comprising a collector coupled to the second output terminal of the mute circuit, a emitter that is grounded, and a base coupled to the cathode of the eighth diode.

* * * * *